United States Patent [19]

Peterson

[11] Patent Number: 4,611,467

[45] Date of Patent: Sep. 16, 1986

[54] METHOD AND APPARATUS FOR THROTTLING GAS FLOW TO A CRYOPUMP

[75] Inventor: John F. Peterson, Lynnfield, Mass.

[73] Assignee: Helix Technology Corporation, Waltham, Mass.

[21] Appl. No.: 742,885

[22] Filed: Jun. 10, 1985

[51] Int. Cl.[4] ..... B01D 8/00

[52] U.S. Cl. ..... 62/55.5; 62/268; 55/269; 417/901

[58] Field of Search ..... 62/100, 268, 55.5; 55/269; 417/901

[56] References Cited

U.S. PATENT DOCUMENTS 4,285,710 8/1981 Welch ..... 62/55.5

4,449,373 5/1984 Peterson et al. ..... 62/55.5

*Primary Examiner*—Ronald C. Capossela

*Attorney, Agent, or Firm*—Hamilton, Brook, Smith & Reynolds

[57] ABSTRACT

Orifices in a cooled plate throttle gases entering a cryopump. Selected orifices are closed by removable closures such as spring clips to allow the throttling to be varied.

7 Claims, 3 Drawing Figures

METHOD AND APPARATUS FOR THROTTLING GAS FLOW TO A CRYOPUMP

BACKGROUND

Cryopumps currently available, whether cooled by open or closed cryogenic cyles, generally follow the same design concept. A low temperature array, usually operating in the range of 4 to 25K, is the primary pumping surface. This surface is surrounded by a higher temperature radiation shield, usually operated in the temperature range of 70 to 130K, which provides radiation shielding to the lower temperature array. The radiation shield generally comprises a housing which is closed except at a frontal array positioned between the primary pumping surface and the chamber to be evacuated. This higher temperature, first stage frontal array serves as a pumping site for higher boiling point gases such as water vapor.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, only a vacuum remains in the work chamber.

In systems cooled by closed cycle coolers, the cooler is typically a two stage refrigerator having a cold finger which extends through the rear of the radiation shield. The cold end of the second, coldest stage fo the cryocooler is at the tip of the cold finger. The primary pumping surface, or cryopanel, is connected to a heat sink at the coldest end of the second stage of the cold finger. This cryopanel may be a simple metal plate or an array of metal baffles arranged around and connected to the second stage heat sink. This second stage cryopanel also supports the low temperature adsorbent. The radiation shield and frontal array are connected to a heat sink, or heat station, at the coldest end of the first stage of the refrigerator.

After several days or weeks of use, the gases which have condensed onto the cryopanels, and in particular the gases which are adsorbed, begin to saturate the system. A regeneration procedure must then be followed to warm the cryopump and thus release the gases and remove the gases from the system.

For many operations the extremely low pressures provided by the cryopump may be lower than desired. For example, for best results in sputtering processes pressures of inert gases in the range of $1\times10^{-4}$ torr to $5\times10^{-2}$ torr may be required. Conventional cryopumps operate most efficiently at pressures below $1\times10^{-5}$ torr.

In conventional systems utilizing cryopumps to create proper conditions for sputtering, inert gases such as argon are injected into the work space during the sputtering operation to raise the work space pressure and provide an inert gas environment. The specific pressure desired is obtained by a balance of argon introduced into the work chamber and argon condensed by the cryopump. It is evident that cryopump regeneration need occur more often if large amounts of inert gas are injected into the environment during operations.

In some systems a throttle valve has been positioned between the cryopump and the work space. The throttle valve serves to create a pressure differential between the work space and the cryopump by restricting the gas flow between the two. By varying the restriction of the throttle valve, the pressure in the work chamber can be varied while minimizing the flow of inert gas into the chamber and ultimately to the cryopump.

Throttle valves add to the complexity of the system and have not been completely successful. Throttle valves held at ambient temperatures may restrict flow of water vapor and the like to the cooled surfaces which capture the water vapor. Such restriction of flow of undesired gases as well as flow of inert gases may result in contamination of the work space. To avoid that problem, frontal valves are more usually cooled to condense and retain the water vapor upstream of the flow restriction. As such, the throttle valves may perform as second stage arrays. A disadvantage of cooled throttle valves is that the condensed water vapor can interfere with the mechanism of the throttle valve and thus prevent or limit its operation after cooldown of the system. Also, the valve adds undesired complexity to the system.

As an alternative to a variable throttle valve, a restriction in the form of a cooled orifice plate has been described in my prior U.S. Pat. No. 4,449,373. In that system, a plate cooled by the first stage of a cryogenic refrigerator has a plurality of circular orifices which restrict flow of gas from the work chamber into the cryopump. That approach has the advantage of structural simplicity with no moving parts.

DISCLOSURE OF THE INVENTION

In accordance with the present invention orifices in a cooled orifice plate are closed by removable closures which are secured to the orifice plate at the orifices. Closures may be selectively removed prior to operation of the system to vary the throttling effect of the orifice plate. The closures provide for a variable flow restriction while maintaining the simplicity of the orifice plate.

A closure may, for example, be a spring clip comprising a circular closure plate slightly larger in diameter than the orifices. Bent spring legs may extend generally normal to the closure plate to press outwardly against the edge of a circular orifice to secure the closure plate against the orifice plate after the spring legs are forced into the orifice. Because the closures are readily removable, a plurality of closures may be independently secured to the orifice plate and the system user can remove individual closures to select the effective flow restriction of the orifice plate to meet specific needs. Preferably, the closures may be readily replaced in the orifice plate to increase the flow restriction.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DESCRIPTION OF A PREFERRED EMBODIMENT

Figure 1:
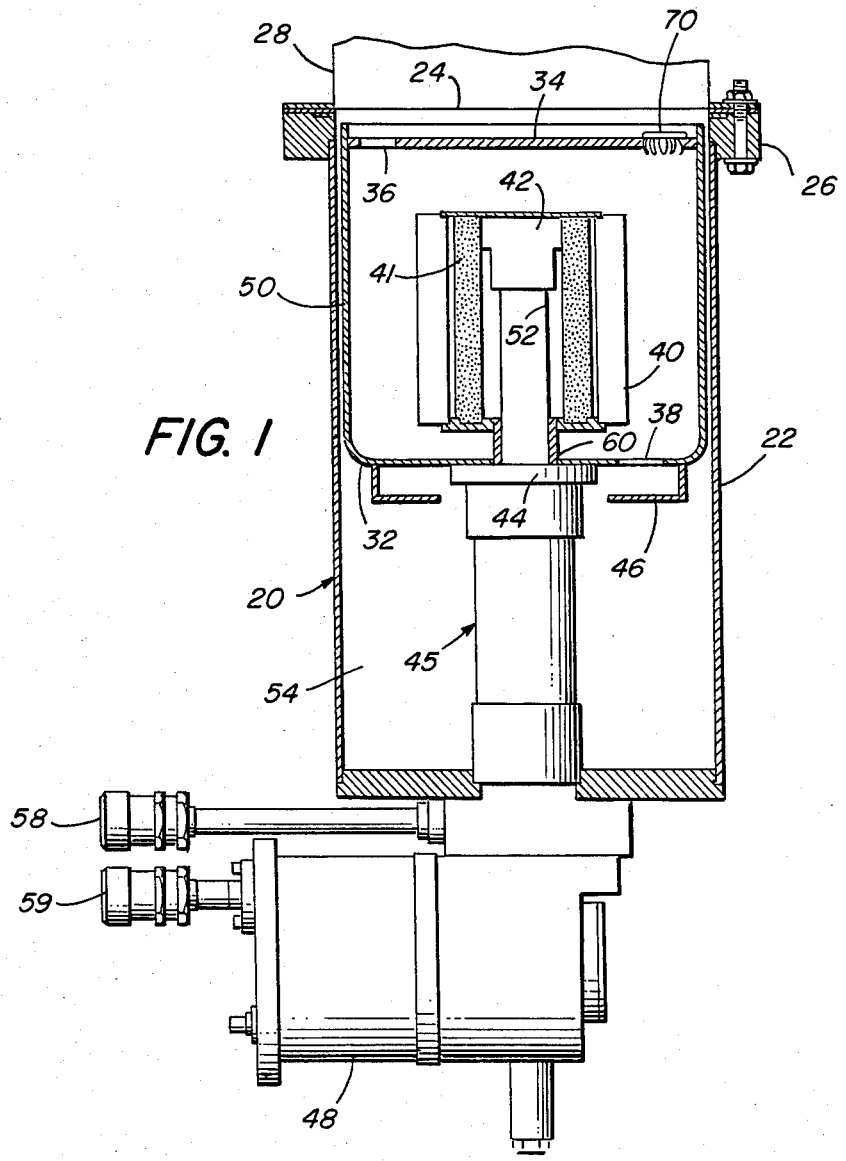
FIG. 1 is an elevational cross section of a cryopump embodying the present invention.

The cryopump 20 in FIG. 1 comprises a main cryopump housing 22 which may be mounted either directly to a work chamber along flange 26 or to an intermediate gate valve between it and the work chamber. The cryopump in this view is bolted to conduit 28 which connects it to the work chamber. A two-stage cold finger 45 of a refrigerator protrudes into the cryopump housing through an opening 66. In this case the refrigerator is a Gifford-MacMahon refrigerator, but others may be used.

A two-stage displacer is arranged within the cold finger 45 and driven by the motor 48. With each cycle helium gas is introduced through input line 59 into the cold finger under pressure and is expanded and thus cooled. It is then exhausted through line 58 to a compressor. Such a refrigerator is disclosed in U.S. Pat. No. 3,218,815 to Chellis et al.

The second stage pumping surface of this embodiment comprises a set of vertical chevrons 40 arranged in an annular array; however, other configurations of the second stage pumping surface would be acceptable for use with this invention. This chevron array, mounted to heat sink 42, operates at a temperature of about 15° K. Enclosed within the annular array of chevrons 40 is an array of panels 41 that hold an adsorbent for low temperature gases. Access to this adsorbent array 41 by extremely low boiling point gases such as hydrogen results in their adsorption and removal from the environment.

Figure 2:
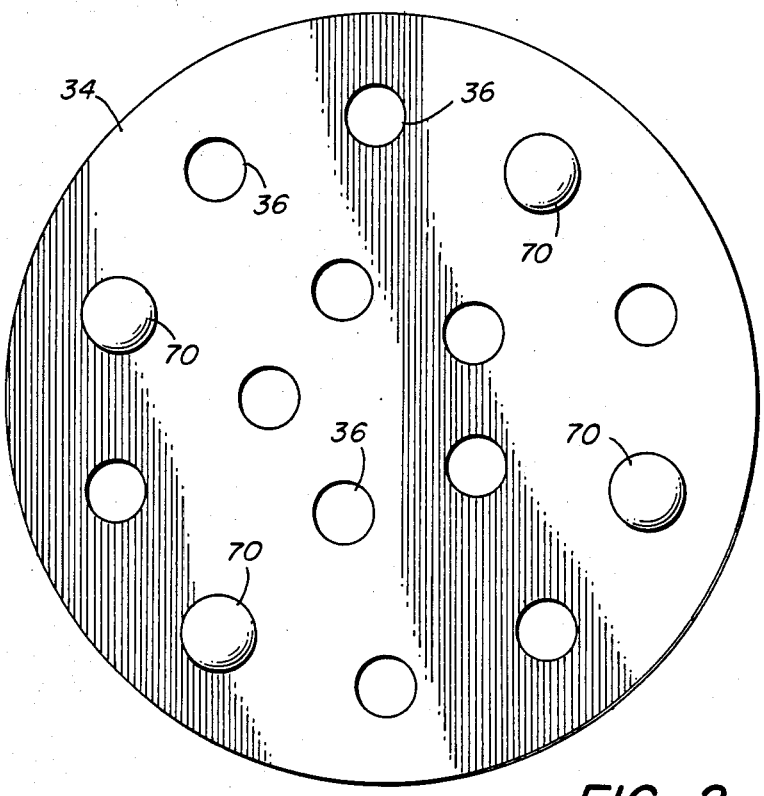
FIG. 2 is a planned view of an orifice plate of the cryopump of FIG. 1.

The cup shaped radiation shield 32, mounted to the first stage heat sink 44, operates at about 77° K. The radiation shield 32 surrounds the second stage cryopumping area and minimizes the heating of that area by direct radiation and higher boiling point vapors. The first stage also comprises a front orifice plate 34. The orifice plate is cooled through the radiation shield 32 and thus serves as both a radiation shield for the second stage and as a cryopumping surface for higher boiling temperature gases such as water vapor. As shown in FIG. 2, the orifice plate 34 has orifice holes 36 which restrict flow of lower boiling temperature gases such as argon to the second stage.

The orifice plate 34 acts in a selective manner because it is held at a temperature approaching that of the first stage heat sink (between 77° and 130° K.), and is therefore an integral part of the cryopump. The orifice plate 34 therefore acts primarily as an orifice only to the lower condensing temperature gases. While the higher condensing temperature gases freeze on the orifice plate itself, the orifices 36 restrict passage of these lower condensing temperature gases to the second stage. By restricting flow to the inner second stage pumping area, a percentage of inert gases, primarily argon, is allowed to remain in the working space to provide a moderate pressure of inert gas for optimal sputtering or other processing. To summarize, of the gases ariving at the cryopump port 24, higher condensing temperature gases are removed from the environment while the flow of lower temperature gases to the second stage pumping surface is restricted. The flow restriction results in a higher pressure in the working chamber.

There is a need to retain a low vacuum in the cryopump housing so as to maintain high cryopump efficiency. It is important that a high vacuum be maintained in the annulus 50 between the radiation shield 32 and the housing 22. If the moderate vacuum of the working space is allowed to exist in that annulus, heat transfer from the housing to the radiation shield results in excessive energy loss and pump inefficiency. This problem has been solved through the use of a pressure gradient established within the cryopump housing by the radiation shield 32 and the differential pumping ports 38. Baffles 46 are positioned over the differential ports 38 in order to prevent heating of the second stage array by radiation from the cryopump housing 22.

FIG. 2 is a plan view of the orifice plate section of the radiation shield. The number of orifice holes 36 and their size determine the pressure maintained in the work space for sputtering operations. Many small holes provide for even distribution of the restricted gas flow through the plate 34. On the other hand, each orifice 36 must be of sufficient size so that ice does not completely close the orifice to lower temperature condensing gases. Ice buildup could prevent entry of lower temperature gases into the second stage pumping area and result in a pressure buildup in the work space. An optimum hole size has been found to be in the range of 0.25 inch to 0.75 inch.

For a given hole size, the degree of flow restriction is determined by the number of holes. The number of holes is therefore varied according to the size of the working space to be evacuated and the desired pressure. For a typical working space used in sputtering, ten holes of approximately ½ inch diameter have been used.

Figure 3:
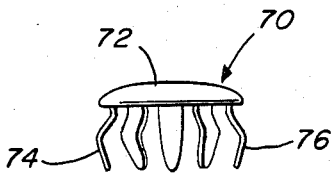
FIG. 3 is an enlarged side view of a closure used to close orifices in end of the plate of FIG. 2.

A disadvantage of past systems utilizing orifice plates has been the inability to vary the flow restriction of the plate on site. The flow restriction has only been varied by varying the number and size of holes during fabrication. In accordance with the present invention selected orifices are closed by removable closures 70. Preferred closures are as shown in FIG. 3. Such closures have in the past been utilized in electrical boxes. Each includes a circular closure plate 72 of a diameter slightly greater than the diameter of the orifices 36. Legs 74, which may be stamped from the same material as the closure plate 72 extended generally normal to the plate. Each leg has a knee 76. To position the closure plate 72 against the orifice plate, the lower portions of the legs 74 are pressed into an orifice 36. The legs then bend inward to allow the knees 76 to pass the orifice plate and then, by spring action, the knees move back out to grip the lower surface of the orifice plate and draw the closure securely against the orifice plate. A closure may be readily removed by prying the plate 72 from the orifice plate to pull the knees 76 above the orifice plate. Individual closures can be removed or replaced to vary the throttling effect of the orifice plate.

The closure of FIG. 3 is particularly suited to the present invention because it can be readily removed or replaced. Another suitable alternative would be a threaded closure which quickly threads into an orifice plate. Alternatively, a closure which is formed as a part of the orifice plate and having score lines to allow for easy removal thereof may be used; but such an arrangement does not provide for easy replacement of a closure.

It is important that the closure have an adequat thermal coupling to the orifice plate. Otherwise, the closures might float at a higher temperature which would prevent sufficient reduction in work chamber pressure.

Good thermal conductance is best but stainless steel slips have been used successfully.

Although the present orifice plate is not as readily varied as more complex throttle valves, it has the great advantage of simplicity. Further, because of freezing, past throttle valves have not always been completely variable except when warmed to near ambient temperature and thus failed to provide an expected advantage. Further, once the throttling action of a valve is established, there is generally little need to vary the valve. As a result, typical expensive and complex throttle valves are often only used during the initial setup of a system. The present invention provides that variability during the system setup without the added complexity of a variable throttle valve.

While the invention has been particularly shown and described with reference to a preferred embodiment thereof, it will be understood by those skilled in the art that various changes in form and details may be made therein without departing from the spirit and scope of the invention as defined by the appended claims. For example, the invention is not limited to sputtering and in some applications may even restrict flow of reactive gases.

I claim:

1. A cryopump comprising a cold first stage and a colder second stage, a second stage cryopanel, a radiation shield surrounding the second stage and a first stage orifice plate closing the radiation shield, the orifice plate having a plurality or orifices therein for allowing restricted flow of gas into the radiation shield to the second stage cryopanel, at least one of the orifices being closed by a removable closure secured to the orifice plate at the closed orifice.

2. A cryopump as claimed in claim 1 wherein the closure is a spring clip.

3. A cryopump as claimed in claim 2 wherein the orifices are circular and the closure comprises a circular plate having bent spring legs extending generally normal thereto which legs press outwardly against the edge of a circular orifice to secure the closure plate against the orifice plate after the spring legs are forced into the orifice.

4. A cryopump as claimed in claim 1 wherein a plurality of orifices are closed by closures independently secured to the orifice plate at the respective closed orifices.

5. A method of regulating flow of gas into a cryopump comprising providing an orifice plate at the inlet to the cryopump, the orifice plate having a plurality of orifices therein, selectively closing one of more orifices in the orifice plate by means of removable closures individually secured to the orifice plate, and thereafter cooling the cryopump, including the orifice plate and closures.

6. A method as claimed in claim 5 wherein the closures are spring clips.

7. A method as claimed in claim 6 wherein the orifices are circular and each closure comprises a circular plate having bent spring legs extending generally normal thereto, which legs press outwardly against the edge of a circular orifice to secure the closure plate against the orifice plate after the spring legs are formed into the orifice.

* * * * *